US005533559A

United States Patent [19]

Judkins

[11] Patent Number: 5,533,559

[45] Date of Patent: Jul. 9, 1996

[54] WINDOW SHADE ASSEMBLY WITH HOLD DOWN

[76] Inventor: Ren Judkins, 46 Newgate Rd., Pittsburgh, Pa. 15202

[21] Appl. No.: 383,879

[22] Filed: Feb. 6, 1995

[51] Int. Cl.[6] ..... E06B 3/94

[52] U.S. Cl. ..... 160/84.06; 160/172

[58] Field of Search ..... 160/84.01, 84.02, 160/84.03, 84.04, 84.05, 84.06, 84.07, 172 R, 279, 370.23, 349.1, 349.2

[56] References Cited

U.S. PATENT DOCUMENTS

| | | | |
|---|---|---|---|
| 2,248,775 | 7/1941 | Nottingham | 160/172 R |
| 2,539,830 | 1/1951 | Hackedorn | 160/172 R |
| 4,202,395 | 5/1980 | Heck et al. | 160/84.06 |
| 4,473,101 | 9/1984 | Langeler | 160/84.06 |
| 4,557,309 | 12/1985 | Judkins . | |
| 4,673,018 | 6/1987 | Judkins | 160/84.06 |
| 4,727,921 | 3/1988 | Vecchiarelli . | |
| 4,865,108 | 9/1989 | Hennequin et al. . | |
| 5,069,264 | 12/1991 | Klawiter . | |

*Primary Examiner*—David M. Purol

*Attorney, Agent, or Firm*—Buchanan Ingersoll; Robert J. Pugh

[57] ABSTRACT

The window shade assembly has a headrail and a bottomrail that are spaced from one another and has window shade material provided therebetween. The window shade assembly has one or more cords traveling through the headrail and through the bottomrail. A first end of each cord is accessible to an operator and a second end of each cord is connected to one of a pair of transfer plates. A pair of brackets is also provided, each having a channel running therethrough. The transfer plates and channels are sized and configured so that the transfer plates are engageable and disengageable with a respective bracket through the channel of that bracket. The transfer plates and channels are also sized and configured so that the transfer plates are rotatably held within the brackets when the transfer plates are inserted within the channels. The bottomrail is raisable and lowerable through manual movement of the bottomrail once the transfer plates are engaged with the brackets, such that the cords act as guide cords for the bottomrail and shade. The bottomrail is also raisable and lowerable by drawing the cords into and out of the headrail once the transfer plates are disengaged from the brackets.

20 Claims, 6 Drawing Sheets

FIG. 4
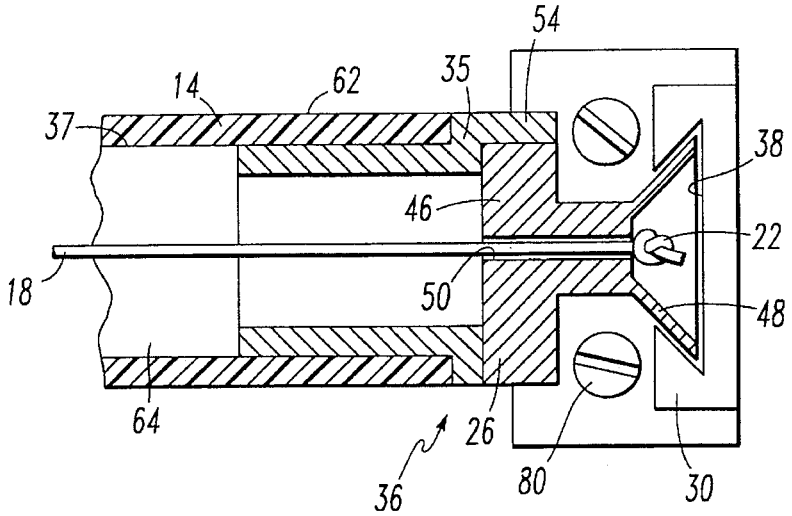
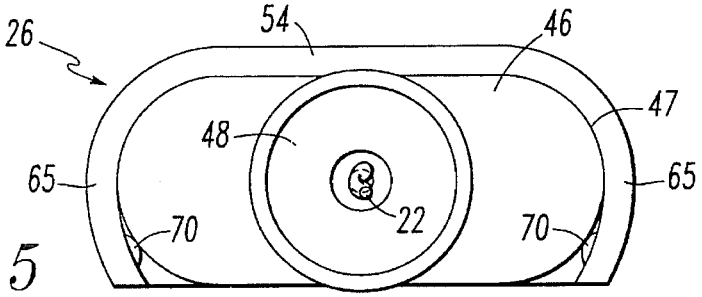
FIG. 5
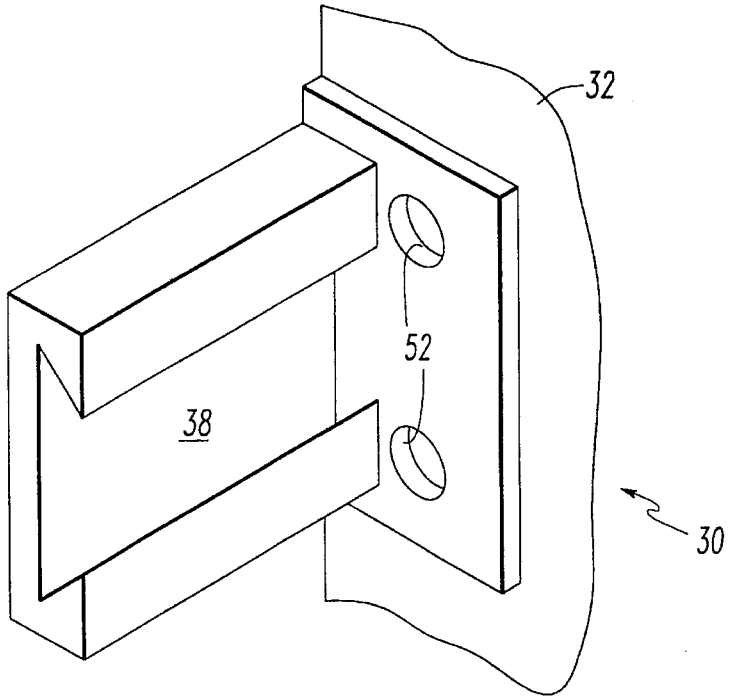
FIG. 6

WINDOW SHADE ASSEMBLY WITH HOLD DOWN

BACKGROUND OF THE INVENTION

1. Field of the Invention

The present invention relates generally to the field of window shade assemblies. More particularly, the invention relates to an improved window shade assembly having a hold down feature which can be raised or lowered by either a use of lift cords or through direct manual movement of the bottomrail.

2. Description of the Prior Art

Window shade assemblies are typically operated by having one or more lift cords being connected at one end to the window shades or to a bottomrail connected to the window shades and having the other ends which extend out of the shade being accessible to the operator. The lift cords typically travel through or along a headrail. The window shades are typically raised by the operator pulling on the accessible portion of the lift cords and are lowered by allowing the weight of the shades to pull the lift cords back into the shades. When the operator has moved the shade to a desired position, the lift cords are held in place so that the shade will remain in the chosen position after the operator has let go of the lift cords. Various types of cord locking devices are used for this purpose.

The prior art of the window shade industry teaches "hold down" type arrangements in which the bottomrail may be locked or snapped into position relative to the window frame. For example, U.S. Pat. No. 4,727,921 to Vecchairelli teaches a venetian type window shade assembly that may be raised and lowered through the use of lift cords. The bottomrail is provided with studs which may be snapped into apertures in the sidewalls of the window frame, such that the bottomrail is locked into place when the studs are thus snapped into the apertures. Vecchairelli provides the use of lift cords to raise and lower the shade. When it is desired to raise the shade, the bottomrail studs are removed from the apertures.

Similarly, U.S. Pat. No. 5,069,264 to Klawiter discloses another hold down type window shade arrangement in which a fixed bracket and a bottomrail are engageable to one another. When the bottomrail and hold down bracket are so engaged, the window covering position is locked and the bottomrail may not be raised.

It is also known in the window shade industry to provide cords which are used to guide the window shade (these cords are referred to as "guide cords"). These guide cords are typically connected to the headrail and extend downward, passing through the bottomrail, before connecting to the surrounding window frame. The guide cords are then placed under tension so that the bottomrail may be raised and lowered directly by manual movement of the bottomrail in which the position of the bottomrail is held by friction between the guide cords and the bottomrail.

It is also generally known in the prior art that some windows, such as the type mounted in various vans, campers and recreational vehicles have a plastic frame which encircles the window. The plastic frames then have holes or indentations provided on them. Guide cords are attached at their ends to plastic anchors which are then affixed to this plastic frame at the time of window installation. The guide cords are thus held in position by the plastic anchors. This type of window assembly provides no means for releasing the plastic anchors except through disassembly of the window assembly by prying out the anchor from the frame. Movement of the bottomrail does not disattach the anchors from the frame.

U.S. Pat. No. 4,865,108 to Hennequin et al. discloses a frame for window shade assembly that provides a number of passageways through the headrail and siderails for cords to pass therethrough. This, according to Hennequin et al., permits a degree of variability for the actuation of the shade. Thus, different actuation means could alternatively be installed during assembly, or the type of actuation means could be changed after assembly. Hennequin et al. do not, however, allow for different actuation means to be simultaneously employed in the window shade assembly.

Thus, there is a need in the prior art to provide a window shade assembly in which alternative actuation means are provided within a single assembled window shade assembly. In particular, it is desirable for a window shade assembly to have a lift cord actuation as well as a direct manual manipulation of the bottomrail.

Such alternative actuation means are desirable for, among other reasons, safety considerations. Lift cords provide an attractive nuisance to young children who may all too frequently be strangled or otherwise injured on the lift cords. A design having alternative actuation means would allow for lift cord operation when no children are present but would also allow for the lift cord to be tied back or otherwise removed from accessibility when children are present in which the shade assembly may still be operated by direct manual movement of the bottomrail.

SUMMARY OF THE INVENTION

The invention provides a window shade assembly that is capable of being raised and lowered through the use of lift cords but may also be raised and lowered by direct manual manipulation of the bottomrail. The window shade assembly has a hold down feature that prevents the window shade from moving out of its normal plane (which in the case of a vertical window pane is away from or toward the window) in response to air currents or to the frame moving as when the shade is mounted to a door or directly to a hinged window frame.

The window shade assembly has a headrail and a bottomrail that are spaced apart from one another. The headrail is generally fixed with respect to the surrounding window frame structure and the bottomrail is movable toward or away from the headrail. Window shade material is provided between the headrail and the bottomrail. The window shade material may be any suitable type, such as pleated fabric, tabbed pleated fabric, cellular fabric, roman shades, venetian blind slats and ladders, or any covering that can be raised and lowered by cords.

The window shade assembly also has one or more and preferably two or more cords traveling through the headrail and through the bottomrail. A first end of each cord is accessible to an operator. A second end of each cord is connected to a respective one of a pair of transfer plates. A pair of brackets is also provided, each having a channel running therethrough. The transfer plates and channels are sized and configured so that the transfer plates are engageable and disengageable with a respective bracket. When the transfer plates are engaged with the bracket, the transfer plates are prevented from moving directly toward the headrail and thus, their position is secured relative to the headrail until disengaged from the bracket. The transfer plates are engaged with the brackets preferably by having a portion of the transfer plates being inserted within the bracket channels. Preferably, the transfer plates have a generally circular extending portion that may be inserted within the bracket channels, such that the transfer plates are rotatably held within the channels of the brackets. In this way, the bottomrail may be pivoted as with Venetian-type shades while the transfer plates are engaged with the brackets.

The bottomrail is raisable and lowerable by manually moving the bottomrail relative to the headrail by engaging the transfer plates with the brackets. With the transfer plates so engaged, the cords are fixed at one end to the brackets and extend upward through the headrail, functioning as guide cords for the bottomrail and shade. Tension is applied to the cords by the operator pulling on the accessible end of the cords and then maintaining the position of the cords such as by locking the cords in a cord lock. The cord lock is preferably located in the headrail. With the cords in tension, friction acting between the cords and the bottomrail maintain the position of the bottomrail and shade when the bottomrail is manually moved.

When the cords are fixed at either end so that the cords are acting as guide cords, slack may be developed in the cord as the bottomrail is moved along the cords. A spring or similar means may be used to take up the slack in the cords. Preferably, the spring is provided within the bottomrail and connects to each cord.

The transfer plates may also be disengaged from the brackets, such as by removing the transfer plate extending portions from the channels of the brackets. With the transfer plates disengaged from the brackets, the bottomrail is then raisable and lowerable relative to the headrail by drawing the cords into and out of the headrail through manipulation of the ends of the cords accessible to an operator. In this mode of operation, the cords function as conventional lift cords. When the transfer plates are removed from the brackets, the transfer plates are drawn towards the bottomrail either through tensioning action of the cords and the spring, or through the cords being pulled by an operator, or the weight of the bottomrail and/or the shade.

In a first preferred embodiment, an even number of cords are used. Each cord has one end which extends outward from the headrail and is accessible to an operator. Each cord then travels downward from the headrail through the window shades and into the bottomrail. Once in the bottomrail, half of the cords travel outward of a respective one of the opposed ends of the bottomrail and is connected to a respective transfer plate. A spring preferably engages all the cords as described above to pick up the slack in the cords. Thus, when the transfer plates are engaged with the brackets, and the cords are functioning as guide cords, the cords and spring provide tension in the guide cords which increases frictional contact between the guide cords and the bottomrail. This tensioning of the guide cords assists in retaining the bottomrail in its selected position relative to the cords through various positions of being raised and lowered. Furthermore, when the transfer plates are disengaged from the brackets, and the cords are functioning as lift cords, the cord tensioning means helps to draw the transfer plates closer to the end of the bottomrail so that the transfer plates do not hang loosely from the bottomrail particularly in certain window coverings where the bottomrail is supported by the window covering, such as the ladders in venetians.

An alternative to the first preferred embodiment is substantially similar to the first embodiment except that instead of or in addition to the use of friction between the cords and the bottomrail, cord locks may be used to maintain the position of the bottomrail once it is raised and lowered relative to the cords when the transfer plates are engaged with the brackets and the cords are functioning as guide cords. Such position maintaining means should be releasable when it is desired to move the bottomrail relative to the cords. One or more, and preferably two cord locks may be used as the position mounting means in which such cord locks are preferably provided at the opposed ends or sides of the bottomrail. Other position maintaining means may be used which may be actuated by an operator while the operator is supporting or otherwise positioning the bottomrail. For example, the cords may be released from the locks by tilting the bottomrail from its normal horizontal position to an angled position.

In another alternative to the first preferred embodiment also substantially similar to the first preferred embodiment instead of or in addition to the spring and/or the cord locks, a clamp may be used to secure the position of the bottomrail relative to the headrail when the transfer plates are engaged with the brackets and the cords are functioning as guide cords. The clamp is attached to the bottomrail and clamps or secures to the cords, thereby preventing the bottomrail from moving relative to the cords. The clamp may be any suitable clamp-like device such as a spring loaded clamp and is preferably located in the middle of the bottomrail. Also, one or more handles may be provided on the bottomrail that disengage the cord locks when they are extended out from the bottomrail by the operator. Such handles preferably automatically collapse along the rail when released by the operator, engaging the cord locks.

In a second preferred embodiment, a single cord is used. The cord has one end which extends outward from the headrail and is accessible to an operator. An opposite end of the cord travels downward from the headrail passing through the shades and enters the bottomrail. Once in the bottomrail, the cord connects to both of the transfer plates. The single cord preferably connects to one transfer plate by looping through a hook or other aperture on that transfer plate. The cord then travels through the bottomrail and is affixed to the second transfer plate. In this embodiment, it is also preferred to include a means for securing the position of the bottomrail relative to the headrail when the transfer plates are engaged with the brackets and the cord is functioning as a guide cord. Tension may be supplied to the lift cords by adjusting the lift cords so that the bottomrail does not extend completely to the brackets and pulling the bottomrail downward and engaging the brackets. A spring can moderate and provide consistent tension in the cord, maintaining the correct amount of frictional contact between the cord and the bottomrail and thus retaining the bottomrail in a selected position relative to the cord.

An alternative to the second preferred embodiment is substantially similar to the second preferred embodiment. However, as an alternative to or in addition to the tensioning spring, one or more, and preferably two cord locks may be provided in the bottomrail to maintain the position of the bottomrail relative to the headrail when the transfer plates are engaged with the bracket channels and the cord is functioning as a guide cord. The cord locks are preferably disposed at opposite ends of the bottomrail.

Yet another alternative to the second preferred embodiment is substantially similar to the second preferred embodiment. However, in addition to or as an alternative to the spring and/or the cord locks, a clamp may be provided within the bottomrail for maintaining the position of the bottomrail relative to the headrail when the transfer plates are engaged with the bracket channels and the cord is functioning as a guide cord. The clamp is attached to the bottomrail and clamps or secures to the cord, thereby preventing the bottomrail from moving relative to the cord.

For any of the above embodiments, it is preferred to include a method for maintaining the position of the bottomrail relative to the headrail when the transfer plates are disengaged from the brackets such that the cords are functioning as lift cords. Although any suitable means for maintaining the position of the bottomrail relative to the headrail may be used, it is preferred to use a cord lock preferably provided in the headrail.

The bottomrail preferably has a ledge that extends outward at opposed ends from longitudinally extending upper, front and back surfaces of the bottomrail. The transfer plates each preferably have a flat portion and a generally circular extending portion which extends outward from the flat portion. With this preferred combination of bottomrail ledge and transfer plate configuration, the bottomrail may be moved upward relative to the transfer plates when the transfer plates are engaged with the brackets, but when the bottomrail is moved forward (away from the window) the flat portions of the transfer plates seat adjacent the back ledge of the bottomrail and the transfer plates may be moved forward and disengaged from the brackets. Conversely, when the bottomrail is moved backwards (toward the window) the plates are carried with it and can thus be engaged with the brackets. When the bottomrail is moved toward the window, the transfer plates will be carried with it if they are not already engaged in the brackets. Therefore, the ledges on the bottomrail capture the transfer plates in all directions of motion except straight up. There are preferably some detents on the side ledges that retain the transfer plates except when they are engaged in the brackets and provide sufficient resistance and can snap past the detents.

Other objects and advantages of the invention will become apparent from a description of certain present preferred embodiments thereof shown in the drawings.

BRIEF DESCRIPTION OF THE DRAWINGS

FIG. 4 is a front view taken in cross section of a portion of the window shade assembly showing the cooperation between the cord, bottomrail, transfer plate and bracket.

FIG. 5 is a front elevational view of a preferred transfer plate.

FIG. 6 is a perspective view of a preferred bracket.

DETAILED DESCRIPTION OF THE PREFERRED EMBODIMENTS

The present window shade assembly incorporates a headrail, a bottomrail, shades provided between the headrail and bottomrail, and one or more cords running through the headrail, shades and bottomrail. The present window shade assembly allows for alternate actuation means for raising and lowering the window shades. Thus, the cords may be used as lift cords in which the bottomrail and shades are raised by pulling on the lift cords, or as guide cords in which the bottomrail and shades may be raised and lowered by manipulation of the bottomrail. This alternate actuation means is provided without the need to disassemble or modify the window shade assembly structure or installation. In either case, raising or lowering the bottomrail directly or indirectly raises or lowers the shades. As is typical, with such window shade assemblies, it is preferred that the cords pass through the window shade so as to keep the window shade in a vertical stack when raised and lowered.

Figure 1:
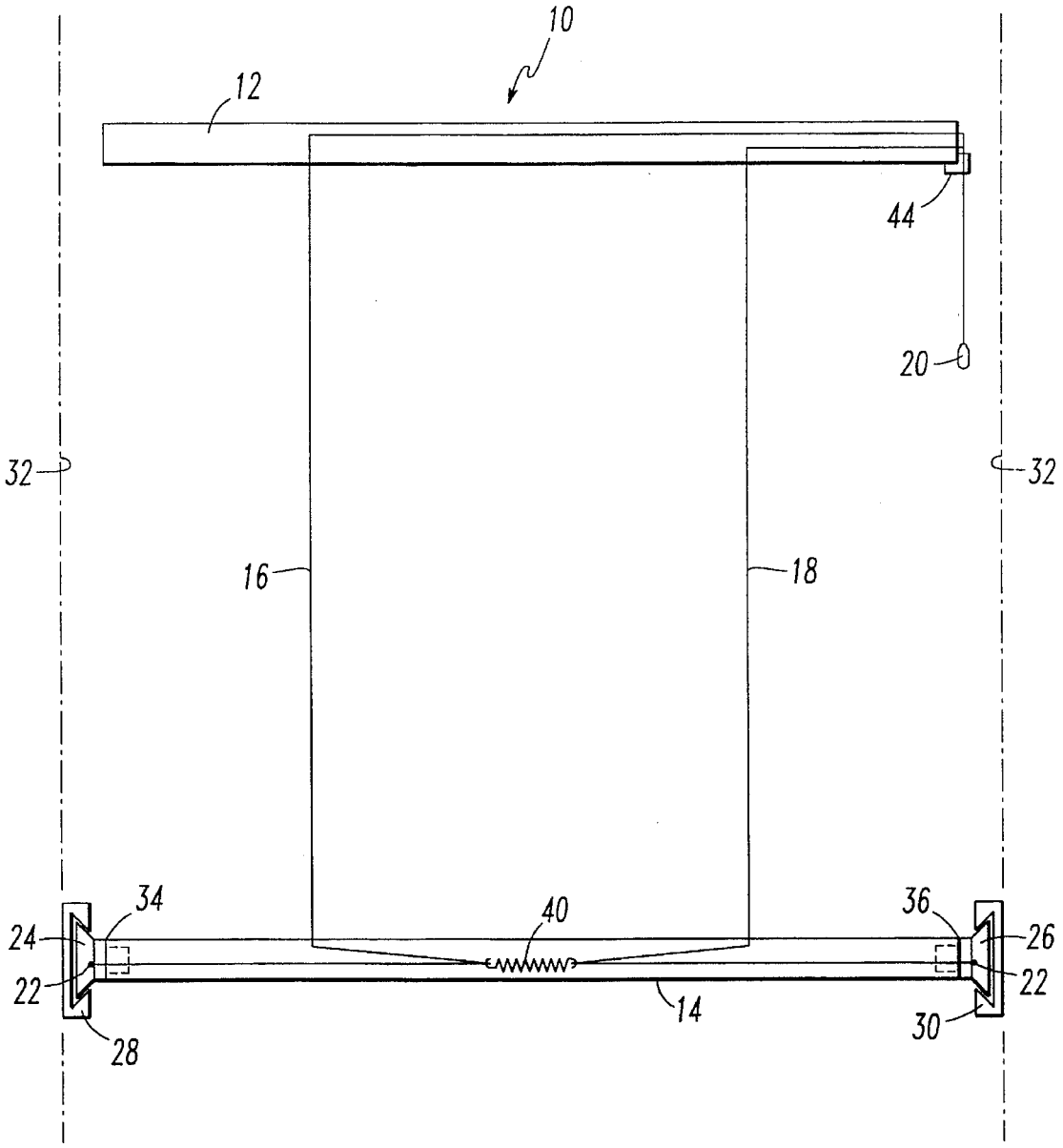
FIG. 1 as schematic depiction of a first preferred window shade assembly.

Referring first to FIG. 1, a first preferred embodiment of the window shade assembly 10 is shown. The window shade assembly 10 has a headrail 12, a bottomrail 14 and a section of window shade material (not shown) provided therebetween. Headrail 12 is fixed in its position by being secured to the surrounding window frame structure or the wall structure surrounding the window shade assembly or to the window sides or sills (collectively designated 32). The window shade assembly 10 also has a first cord 16 and a second cord 18.

Each of the cords 16, 18 have a first end 20 and a second end 22. The first ends 20 of the cords 16, 18 travel out of the headrail 12 and are accessible to an operator. The cords 16, 18 are provided through the headrail 12, extend downward preferably vertically at selected locations from the headrail 12 and enter the bottomrail 14. The second ends 22 of cords 16, 18 then exit from respective opposed ends 34, 36 of bottomrail 14. The second end 22 of the first cord 16 then exits a first end 34 of bottomrail 14 and is affixed or otherwise engaged to a first transfer plate 24. Similarly, the second cord 18 enters the bottomrail 14 and travels out of a second end 36 of the bottomrail 14 and is attached or otherwise engaged to a second transfer plate 26. The second ends 22 of the cords 16, 18 are affixed to the transfer plates 24, 26, by any suitable means, such as by passing through an aperture in the transfer plates 24, 26 and having the distal ends of the cords 16, 18 knotted as will be described in more detail below.

Although the preferred embodiments are shown and described in terms of two opposed ends to each cord, it is distinctly understood that at either "end" of the cords, the cords may be looped in which the loops are considered ends of the cords. Thus, for example, the first end 20 of the cords 16, 18 after exiting the headrail 12 may be looped and extend back into the headrail 12. The looped portion of cords 16, 18 extending outward of the headrail 12 and being accessible to an operator would thus be the first end 20 of cords 16, 18. Similarly, the second ends 22 of cords 16, 18 may be looped and pass through hooks or apertures (not shown in FIG. 1) in the transfer plates 24, 26 and then travel outward away from transfer plates 24, 26. The cords 16, 18 would thus be engaged to transfer plates 24, 26 by being looped through them.

The first transfer plate 24 is engageable and disengageable with a first bracket 28. Likewise, the second transfer plate 26 is engageable and disengageable with a second bracket 30. Brackets 28, 30 are secured to the surrounding window frame structure 32. Thus, the brackets 28, 30 are fixed in their position relative to the headrail 12.

Transfer plates 24, 26 are engageable and disengageable with the respective brackets 28, 30 by any suitable means.

The preferred means is by providing the brackets 28, 30 with respective channels 38 (not shown in FIG. 1) through which portions of the transfer plates 24, 26 may be inserted and removed as will be described in more detail below.

Although the preferred embodiment describes engaging and disengaging the transfer plates 24, 26 with respective brackets 28, 30 in order to secure the positions of the transfer plates 24, 26, any suitable means for securing the position of transfer plates 24, 26 may be used. Thus, although it is preferred to provide brackets 28, 30 which are secured to the surrounding window frame structure 32, the transfer plates 24, 26 may be engageable and disengageable directly to the surrounding window frame structure 32. Thus, channels, indentations or other apertures may be provided directly upon the surrounding window frame structure 32.

Figure 2:
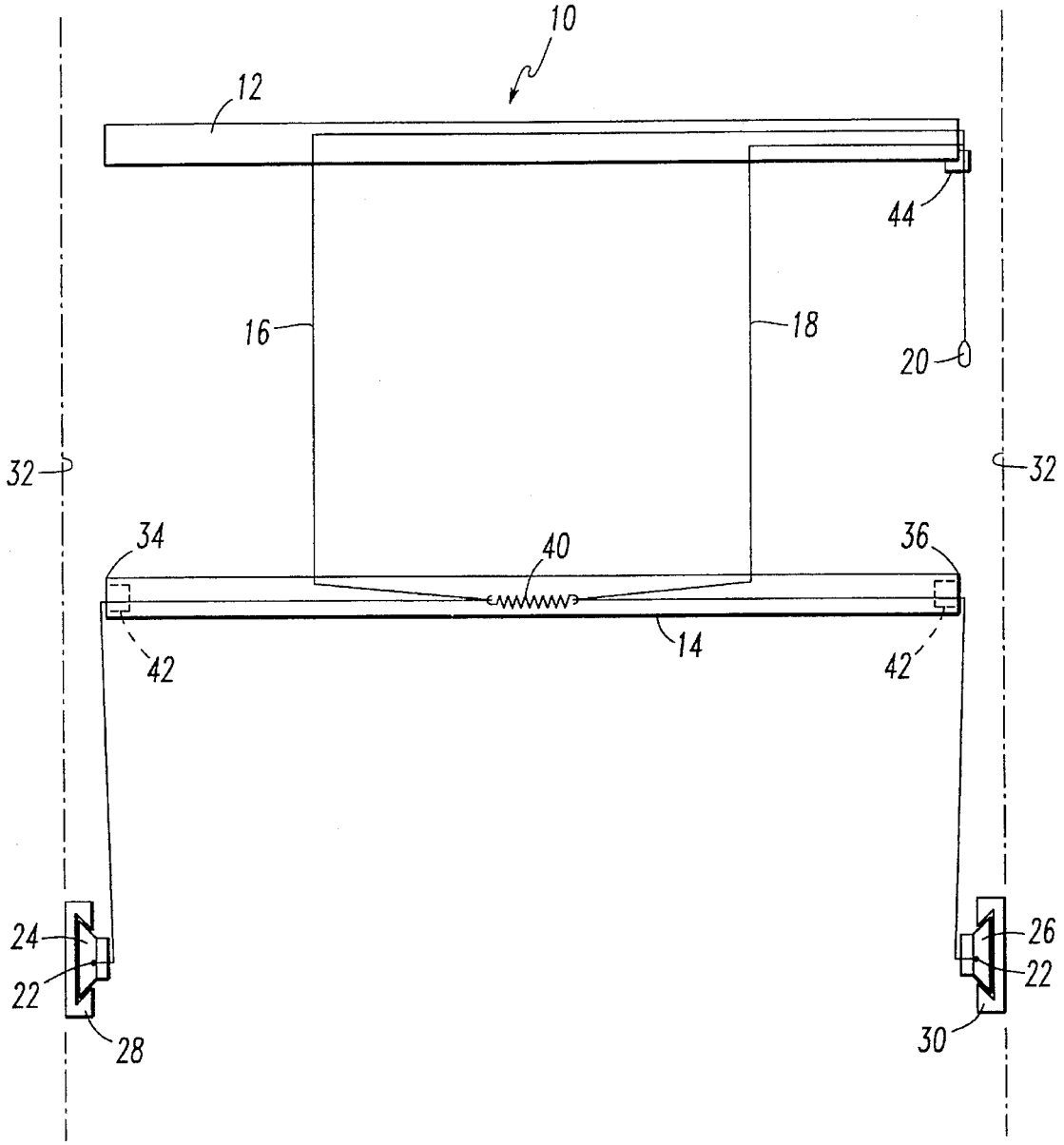
FIG. 2 is a schematic depiction of the window shade assembly of FIG. 1 shown partially raised in the guide cord mode of operation.

Referring next to FIG. 2, the operation of the window shade assembly 10 is shown in the guide cord mode of operation. With the transfer plates 24, 26 engaged with respective brackets 28, 30, the cords 16, 18 remain in a fixed position and therefore act as guide cords. Movement of the bottomrail 14 upward towards the headrail 12 allows bottomrail 14 to travel over cords 16, 18 which remain stationary. Note that in the guide cord mode of operation, it is not necessary for an operator to pull or otherwise manipulate the first end 20 of cords 16, 18, except to adjust the tension in the cords 16, 18, if necessary. As the bottomrail 14 is moved upward toward headrail 12, first end 34 of bottomrail 14 separates from first transfer plate 24 which is in engagement with first bracket 28. Similarly, second end 36 of bottomrail 14 separates from second transfer plate 26 which is in engagement with second bracket 30. With transfer plates 24, 26 in engagement with brackets 28, 30, the second ends 22 of cords 16, 18 are retained in a fixed position. Cord lock 44 prevents the first ends 20 of cords 16, 18 from traveling into headrail 12 when the window shade assembly is in guide cord mode. Cord lock 44 therefore establishes the tension in cords 16, 18 by maintaining the position of the first ends 20 of cords 16, 18. Thus, in this mode of operation, the first and second ends 20, 22 of cords 16, 18 are fixed. As noted above, any suitable cord lock, cleat, or clamping device may be used for this purpose.

In the guide cord mode of operation, it is necessary to provide a means for retaining the selected position of the bottomrail 14 relative to the headrail 12 once bottomrail 14 has been moved. Furthermore, in either mode of operation, it is preferred that the cords 16, 18 are kept relatively taut. Thus, means for maintaining the proper tension (i.e., taking up the slack) of the cords 16, 18 over a wide range of positions of the bottomrail 14 along the cords 16, 18 is preferably provided. The preferred means of maintaining the proper tension on the cords 16, 18 is through the use of a spring 40. Spring 40 connects the two cords 16, 18 and spring 40 may or may not be secured to the bottomrail 14. The frictional contact between cords 16, 18 and the bottomrail 14 serves to hold the position of the bottomrail 14.

As an alternative or in addition to the friction between the bottomrail and the cords 16, 18, other means for retaining the bottomrail 14 in selected positions relative to the headrail 12 may be used. Such other retaining means may include cord locks 42 (shown in dotted line). Any suitable type of cord lock device may be used, such as a cam-like tumbler, jaw pins or those having a jaw-like cord lock structure. Examples of suitable cord locks are described in U.S. Pat. No. 4,660,612 to Anderson, U.S. Pat. No. 4,443,915 to Niemeyer, U.S. Pat. No. 4,413,664 to Istha and U.S. Pat. No. 5,275,222 to Judkins which are herein incorporated by reference.

Figure 3:
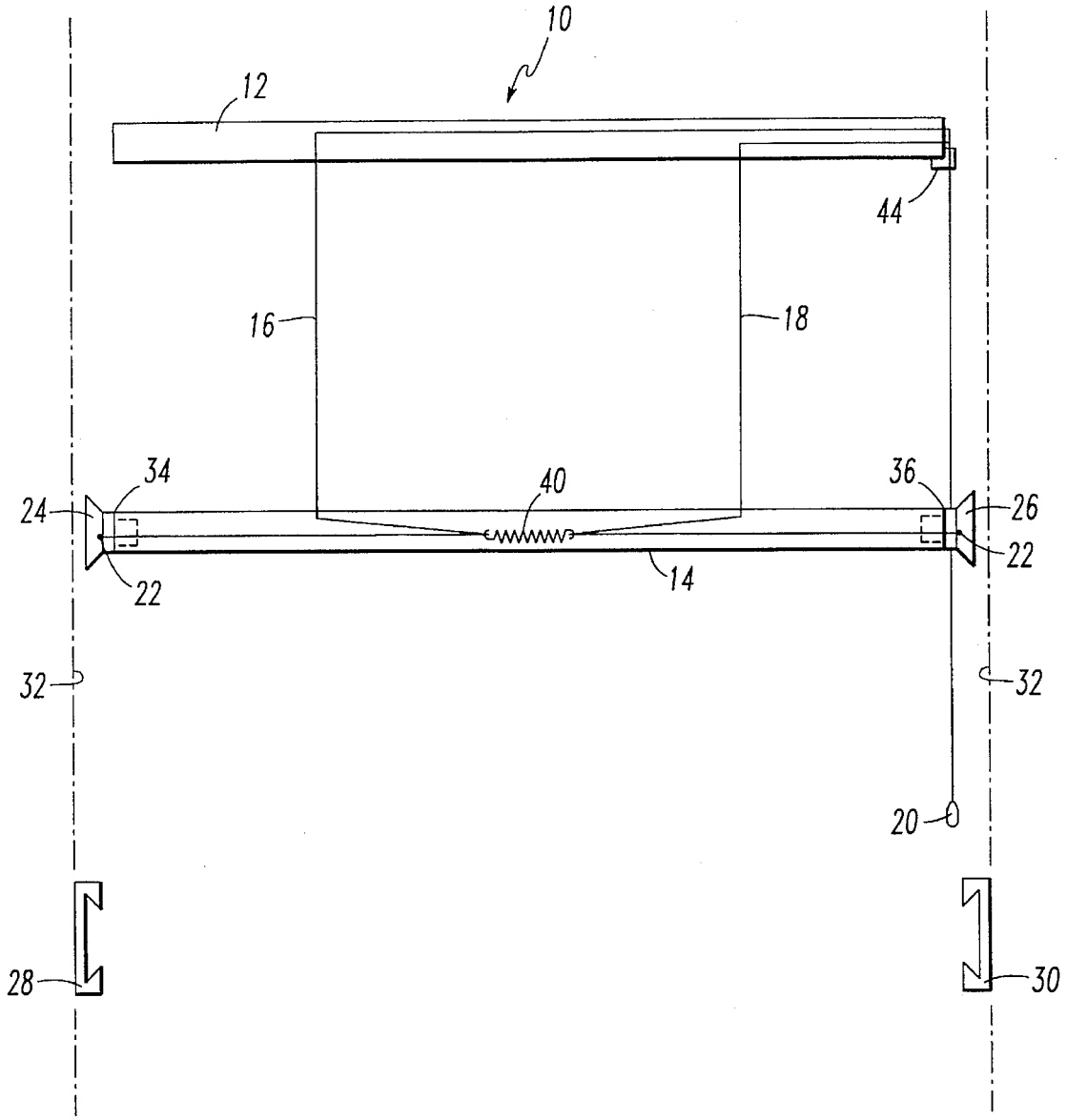
FIG. 3 is a schematic depiction of the window shade assembly of FIG. 1 shown partially raised in the lift cord mode of operation.

Referring next to FIG. 3, the lift cord mode of operation is shown. When the transfer plates 24, 26 are disengaged from their respective brackets 28, 30, the window shade assembly 10 is in a lift cord mode of operation. With the transfer plates 24, 26 thus disengaged, an operator pulling upon the first ends 20 of cords 16, 18 causes the transfer plates 24, 26 and the bottomrail 14 to be pulled upward towards the headrail 12.

In this lift cord mode of operation, means are provided for maintaining the position of the bottomrail 14 relative to the headrail 12. Preferably cord lock 44 is provided for this function. Cord lock 44 is preferably provided in the headrail 12. Lowering bottomrail 14 and re-engagement of transfer plates 24, 26 with brackets 28, 30 again places the window shade assembly into the guide cord mode.

The preferred means of engagement and disengagement of the transfer plates 24, 26 with brackets 28, 30 will now be described with reference to FIGS. 4–6. Referring first to FIGS. 4 and 5, the second transfer plate 26 is shown. Transfer plate 26 preferably has a flat portion 46 and an extending portion 48 which extends outward from flat portion 46. As can be seen best in FIG. 5, extending portion 48 is preferably circular. As can be seen best in FIG. 4, extending portion 48 is also preferably beveled. An aperture 50 runs through the length of transfer plate 26. Cord 18 may be affixed to transfer plate 26 by traveling through aperture 50 and having the second end 22 of the cord 18 being knotted. For ease of illustration, only the second cord 18, the second transfer plate 26 and the second bracket 30 are shown. However, it is distinctly understood that the first cord 16, the first transfer plate 24 and the first bracket 28 are substantially similar and operate in substantially the same fashion as the second cord 18, second transfer plate 26 and second bracket 30.

Referring next to FIGS. 4 and 6, second bracket 30 may be seen. Bracket 30 has a channel 38 provided therethrough. Channel 38 is angled so as to mate with the transfer plate extending portion 48. Bracket 30 is affixed to the surrounding window frame structure or the surrounding wall structure 32 by any convenient means, but is preferably secured in place through the use of screws 30 provided through screw openings 52.

Referring next to FIGS. 4 and 5, bottomrail 14 has a longitudinally extending upper surface and longitudinally extending side surfaces. Bottomrail 14 preferably has a ledge 54 that extends outward at the opposed ends 34, 36 of bottomrail 14 as an extension of the upper surface 62 and side surfaces 64 of the bottomrail 14. The ledge 54 is preferably formed by inserting plugs 35 into respective bottomrail ends 34 and 36 (a plug 35 is only shown in the second end 36 of the bottomrail 14 in FIG. 4 although the plug incorporated with the first end 34 would be substantially similar). Ledge 54 provides a means whereby the operator can move the transfer plates 24, 26, downward, forward or backward by moving the bottomrail 14. There is thus no need for the operator to touch or handle the transfer plates 24, 26.

It is preferred that the transfer plate flat portions 46 have sides 47 which are tapered or curved. Similarly, it is preferred that bottomrail ledge 54 be tapered or curved at the side surfaces 65. Thus, the tapered sides 47 of the transfer plate flat portions 46 lead into the bottomrail side ledges 65. It is also preferred to provide the bottomrail side ledges 65 with slight detents 70. The detents 70 retain the transfer plates 24, 26 within the bottomrail ledge 54. Preferably, the detents 70 or the bottomrail ledge side surfaces 64 or both are made of plastic or some other flexible material. In this way, as the transfer plates 24, 26 are inserted within the bottomrail ledge 54, the transfer plate side portions 46 will move the detents 70 and/or the bottomrail ledge side surfaces 64 outward so that the transfer plates may be snapped into place therein. In this way, the transfer plates 24, 26 may be maintained neatly in the bottomrail but may also be removed from the bottomrail ledge 54 when the transfer plates 24, 26 are engaged to the brackets 28, 30 and the bottomrail is moved upward towards the headrail 12. Furthermore, the detents 70 also allow the transfer plates 24, 26 to be maintained within the bottomrail during handling, shipping and installation.

Figure 7:
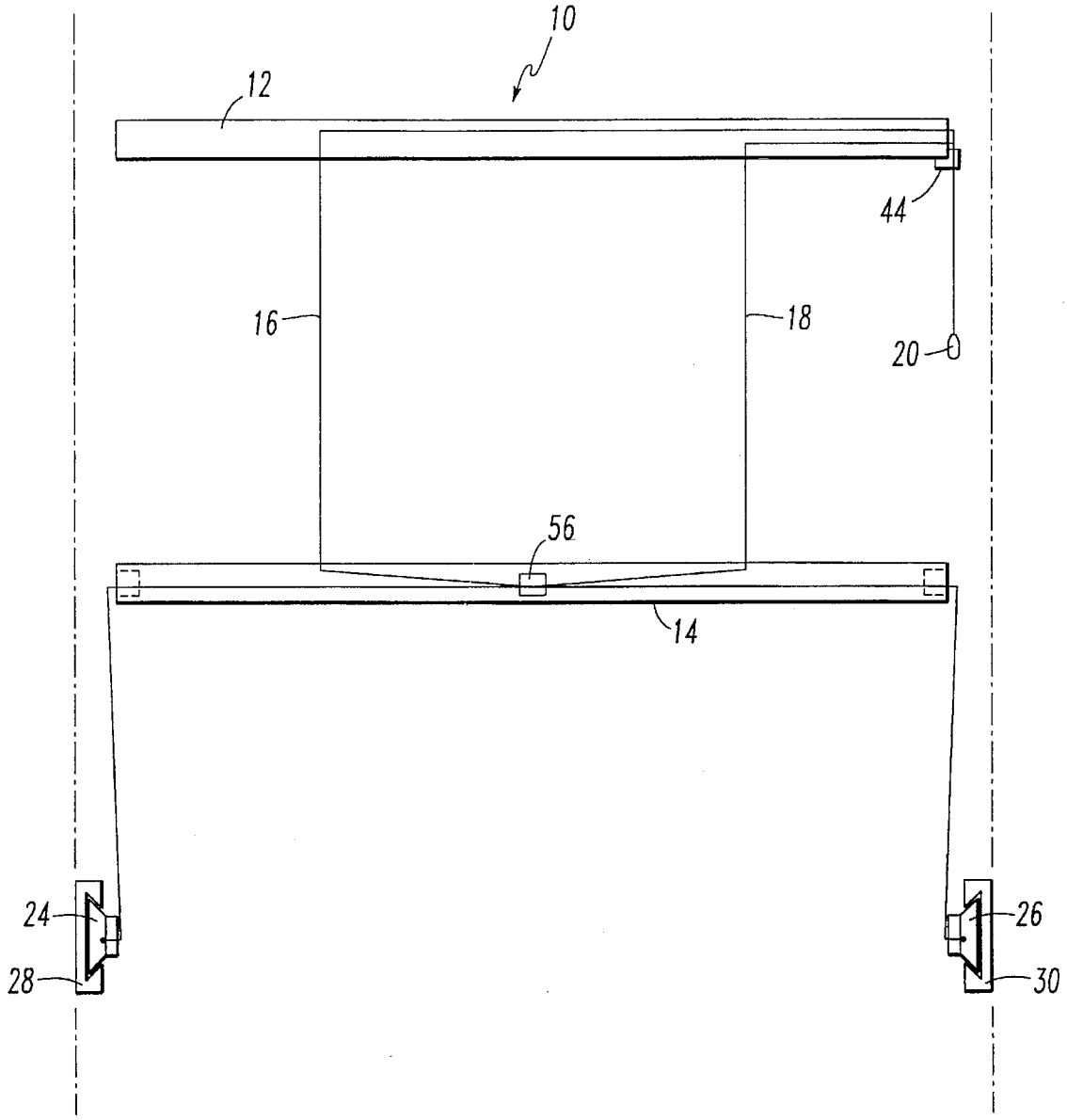
FIG. 7 is a schematic depiction of the window shade assembly of FIG. 1 in the guide cord mode of operation showing an alternative means for retaining the position of the bottomrail.

Referring next to FIG. 7, an alternative means for retaining the position of bottomrail 14 relative to headrail 12 when the window shade assembly 10 is in the guide cord mode is shown. A clamp 56 is preferably provided in bottomrail 14. Cord 16, 18 preferably pass through or between clamp 56 and may be secured thereby. Preferably, clamp 56 may have an extending portion that can act as a handle and be manipulated by an operator to move the bottomrail 14. Clamp 56 may be any clamp type device such as a spring biased clamp such that when the operator releases the clamp 56, the clamp 56 automatically clamps or secures to the cords 16, 18.

However, it remains aesthetically desirable to have springs attached to the cords 16, 18 to maintain tension in the cords 16, 18 particularly the section of cords 16, 18 between the transfer plates 24, 26 and the bottomrail 14 when the window shade assembly is in the guide cord mode.

Figure 8:
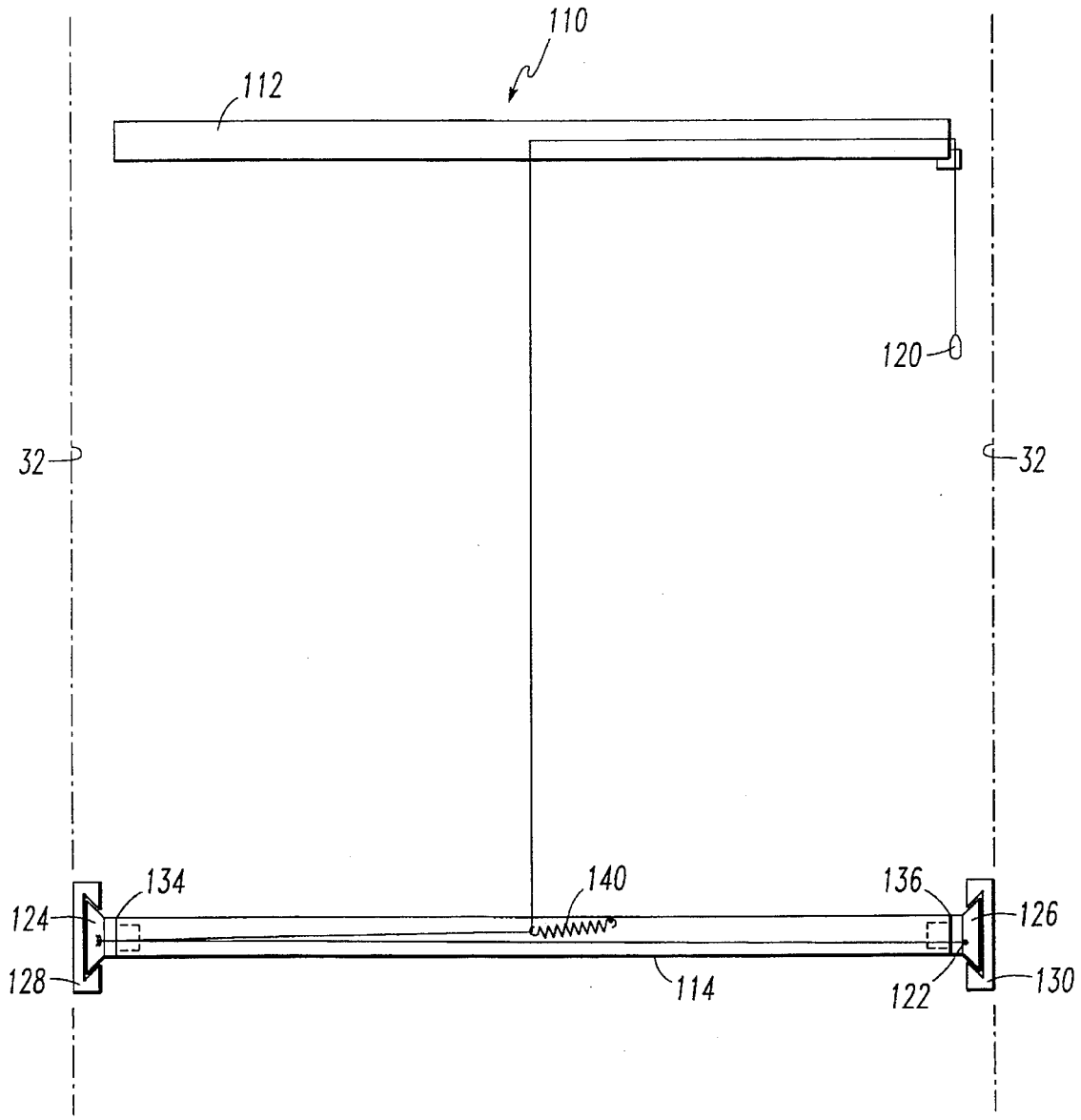
FIG. 8 is a schematic depiction of a second preferred window shade assembly.

Referring next to FIG. 8, a second preferred embodiment of window shade assembly 110 is shown. The second preferred window shade assembly 110 operates in substantially similar fashion as the first preferred window shade assembly 10 in that window shade assembly 110 has a headrail 112, a bottomrail 114 and a second of window shade material (not shown) provided therebetween. Headrail 112 is fixed in its position by being secured to the surrounding window frame structure or the wall structure surrounding the window shade assembly or to the window sills or sides (collectively designed as 32). However, window shade assembly 110 has a single lift cord 117. Lift cord 117 has a first end 120 and a second end 122. The first end 120 of the lift cord 117 travels out of the headrail 112 and is accessible to an operator. The cord 117 travels through the headrail 112, extends downward, preferably vertically, and enters the bottomrail 114. The cord 117 then exits a first end 134 of the bottomrail 114 and movable engages the first transfer plate 124. The preferred means for the cord 117 to movably engage the first transfer plate 124 is to have the cord 117 loop around a hook or opening 139. The second end 122 of cord 117 then travels through bottomrail 114 and affixes to second transfer plate 126. The second end 122 of cord 117 is affixed to the second transfer plate 126 by any suitable means, such as by passing through an aperture in the second transfer plate 126 and having the distal end of the cord 117 knotted as described above.

As described above in reference to the first preferred embodiment of the window shade assembly 10, the first and second transfer plates 124, 126 of the second preferred window shade assembly 110 are engageable and disengageable with respective first and second brackets 128, 130. Brackets 128, 130 are secured to the surrounding window frame structure 32. Thus, the brackets 128, 130 are fixed in their position relative to the headrail 112. The operation of the second preferred window shade assembly 110 is substantially similar to the operation of the first preferred window shade assembly in that it may operate in either a lift cord mode of operation or a guide cord mode of operation. With the transfer plates 124, 126 engaged with respective brackets 128, 130, the cord 117 remains in a fixed position and therefore acts as a guide cord. Movement of the bottomrail 114 towards the headrail 112 allows the bottomrail 114 to travel over the cord 117 which remains stationary.

As discussed above, in the guide cord mode of operation, it is necessary to provide a means for retaining the selected position of the bottomrail 114 relative to the headrail 112 once the bottomrail 114 has been moved. Thus, a means for tensioning the cord 117 is preferably provided. The preferred means of providing tension on the cord 117 is through the use of a cord lock and a spring 140. Spring 140 engages the cord 117 and is secured to the bottomrail 114. Alternative means for retaining the position of the bottomrail 114 relative to the headrail 112 may be used. For example, cord locks (not shown in FIG. 8) preferably provided on the bottomrail 114 or a clamp-type device (not shown in FIG. 8) also preferably provided on the bottomrail 14 may be used, each have been discussed with reference to the first preferred window shade assembly 10 above.

When the transfer plates 124, 126 are disengaged from their respective brackets 128, 130, the window shade assembly 110 is in a lift cord mode of operation. Thus, an operator pulling upon the first end 20 of cord 117 causes the transfer plates 124, 126 and the bottomrail 114 to be pulled upward towards the headrail 112.

In the lift cord mode of operation, means are provided for maintaining the position of the bottomrail 114 relative to the headrail 112. Cord lock 144 is provided for this function. Cord lock 144 is preferably provided in the headrail 112. Re-engagement of transfer plates 124, 126 with brackets 128, 130 again places the window shade assembly 110 into the guide cord mode. The transfer plates 124, 126 and brackets 128, 130 are substantially the same as to the transfer plates 24, 26 and brackets 28, 30 of the first preferred window shade assembly 10.

Although the window shade assembly 110 has been described in terms of the first transfer plate 124 having aperture 139 and the cord 117 being affixed to the second transfer plate 126, cord 117 may instead travel through second transfer plate 126 and attach to first transfer plate 124.

Other variations of the preferred embodiments may be made. For example, although the extending portion of the transfer plates are beveled and the bracket channel is correspondingly angled to receive the transfer plate extending portion, it is distinctly understood that any shape and size of the extending portion and bracket channel may be used, so long as the extending portion may be retained within and removed from the bracket channel.

Also, although the preferred embodiments have been shown and described with one or two cords, any number of cords may be used. When more than two cords are used with the window shade assembly, more than one cord must engage a single transfer plate.

Furthermore, as described above, although the preferred embodiments utilize brackets, any means for selectively securing the position of the transfer plates relative to the headrail may be used. Thus, a channel as described with respect to the brackets or any type of aperture may be provided upon the surrounding window frame structure.

While certain present preferred embodiments have been shown and described, it is distinctly understood that the invention is not limited thereto but may be otherwise embodied within the scope of the following claims.

I claim:

1. A window shade assembly comprising:

a headrail;

a bottomrail spaced from said headrail and being movable toward or away from said headrail;

window shade material provided between and lying in a plane between said headrail and said bottomrail;

at least one cord traveling through said headrail and through said bottomrail, wherein a first end of said at least one cord is accessible to an operator;

a pair of transfer plates, each such transfer plate being connected to a second end of said at least one cord;

means for retaining said transfer plates in a fixed position relative to said headrail and for releasing said transfer plates from said fixed position;

wherein said bottomrail is raisable and lowerable relative to said headrail by retaining said transfer plates in said fixed position and manually moving said bottomrail; and wherein said bottomrail is also raisable and lowerable relative to said headrail by releasing said transfer plates from said fixed position and drawing said at least one cord into and out of said headrail.

2. The window shade assembly of claim 1 wherein said means for retaining and releasing said transfer plates from said fixed position comprising a pair of brackets, wherein said transfer plates are each engageable and disengageable with a respective bracket.

3. The window shade assembly of claim 2 wherein each said bracket having a channel provided therethrough, and wherein an extending portion of said transfer plates are insertable in and removable from a respective bracket through said channel.

4. The window shade assembly of claim 3 wherein said transfer plate extending portions are generally circular such that said transfer plates are rotatably held by said brackets when said transfer plate extending portions are inserted within said channels.

5. The window shade assembly of claim 3 wherein said transfer plate extending portions are tapered.

6. The window shade assembly of claim 1 wherein said means for retaining and releasing said transfer plates from said fixed position comprising a retaining channel and wherein said transfer plates are each engageable and disengageable within a respective retaining channel.

7. The window shade assembly of claim 6 wherein said retaining channel is provided upon window frame structure.

8. The window shade assembly of claim 1 wherein said window shade materials is a type selected from the group consisting of pleated fabric, cellular fabric, roman shade and venetian blind.

9. The window shade assembly of claim 1 wherein said bottomrail has a ledge that extends outward at opposed ends from a longitudinally extending upper surface of said bottomrail, and wherein said transfer plates each have a generally flat portion such that said bottomrail may be moved upward relative to said flat portions when said transfer plates are retained in said fixed position, but said ledge contacts said flat portions, moving said flat portions when said bottomrail is moved downward.

10. The window shade assembly of claim 9 wherein said ledge also extends outward at opposed ends from side surfaces of said bottomrail such that said ledge moves said transfer plates when said bottomrail is moved in a direction generally perpendicular to the plane of the window shade material.

11. The window shade assembly of claim 10 wherein said ledge is tapered at said side surfaces.

12. The window shade assembly of claim 1 further comprising means for retaining said bottomrail in a selected position relative to said headrail when said transfer plates are retained in said fixed position.

13. The window shade assembly of claim 12 wherein said means for retaining said bottomrail position relative to said headrail comprises friction between said at least one cord and said bottomrail.

14. The window shade assembly of claim 13 further comprising a spring for maintaining tautness in said at least one cord while said bottomrail is repositioned relative to said headrail.

15. The window shade assembly of claim 14 wherein said spring is provided within said bottomrail.

16. The window shade assembly of claim 12 wherein said means for retaining said bottomrail position relative to said headrail comprises at least one cord lock.

17. The window shade assembly of claim 16 wherein said at least one cord lock is provided on said headrail.

18. The window shade assembly of claim 16 wherein said at least one cord lock is provided on said bottomrail.

19. The window shade assembly of claim 12 wherein said means for retaining said bottomrail position relative to said headrail comprises a clamp provided on said bottomrail, said clamp being selectively securable and releasable to said at least one cord travelling through said bottomrail.

20. The window shade assembly of claim 19 wherein said clamp is spring biased so that said clamp releases said at least one cord when said clamp is actuated by said operator and said clamp secures to said at least one cord when said clamp is released by said operator.

* * * * *